US009580864B2

(12) United States Patent
Lindstrom et al.

(10) Patent No.: US 9,580,864 B2
(45) Date of Patent: Feb. 28, 2017

(54) KRAFT COOKING METHOD USING POLYSULFIDE COOKING LIQUOR

(71) Applicant: Valmet AB, Sundsvall (SE)

(72) Inventors: Mikael Lindstrom, Lidingö (SE); Fredrik Wilgotson, Sundsvall (SE)

(73) Assignee: Valmet AB, Sundsvall (SE)

( * ) Notice: Subject to any disclaimer, the term of this patent is extended or adjusted under 35 U.S.C. 154(b) by 0 days.

(21) Appl. No.: 15/283,711

(22) Filed: Oct. 3, 2016

(65) Prior Publication Data

US 2017/0022663 A1 Jan. 26, 2017

Related U.S. Application Data

(63) Continuation-in-part of application No. 14/241,141, filed as application No. PCT/SE2011/051038 on Aug. 30, 2011, now abandoned.

(51) Int. Cl.

| | |
|---|---|
| ***D21C 3/02*** | (2006.01) |
| ***D21C 3/24*** | (2006.01) |
| ***D21C 3/26*** | (2006.01) |
| ***D21C 7/06*** | (2006.01) |

(52) U.S. Cl.

CPC ..... *D21C 3/022* (2013.01); *D21C 3/24* (2013.01); *D21C 3/26* (2013.01); *D21C 7/06* (2013.01)

(58) Field of Classification Search

CPC . D21C 1/06; D21C 1/00; D21C 3/022; D21C 3/24; D21C 7/06; D21D 5/00–5/28

See application file for complete search history.

(56) References Cited

U.S. PATENT DOCUMENTS

| | | | | |
|---|---|---|---|---|
| 3,567,572 | A | 3/1971 | Clayton et al. | |
| 3,664,919 | A | 5/1972 | Clayton et al. | |
| 3,886,035 | A * | 5/1975 | Laakso | D21D 5/02 162/55 |
| 5,672,245 | A * | 9/1997 | Andtbacka | D21C 3/22 162/17 |
| 7,828,930 | B2 * | 11/2010 | Jiang | D21C 3/022 162/36 |

(Continued)

FOREIGN PATENT DOCUMENTS

| | | |
|---|---|---|
| CA | 2763651 | 12/2010 |
| CN | 101861426 | 10/2010 |

(Continued)

OTHER PUBLICATIONS

Sixta, H. Handbook of Pulp, vol. 1, 2006, pp. 189-192.
H-Factor Calculation by knowpulp.com, performed Aug. 6, 2014.
Teder A., The Effect of Stability of Polysulfide Solutions, 1965, Svensk Papperstidning, 68: 23, 825.

(Continued)

*Primary Examiner* — Anthony Calandra
(74) *Attorney, Agent, or Firm* — Fasth Law Offices; Rolf Fasth

(57) ABSTRACT

The method is for the preparation of kraft pulp with increased pulping yield from lignin-containing cellulosic material using polysulfide cooking liquor. In order to increase carbohydrate stabilization and hence the yield from a kraft cooking process a first impregnation stage using polysulfide cooking liquor is implemented at high alkali and polysulfide concentration and at a low temperature. Knots are added to a high-pressure conduit extending between an impregnation vessel and a digester.

8 Claims, 6 Drawing Sheets

(56) References Cited

U.S. PATENT DOCUMENTS

| | | | | |
|---|---|---|---|---|
| 2003/0102092 | A1* | 6/2003 | Stromberg | D21C 7/06 162/52 |
| 2009/0126883 | A1 | 5/2009 | Jiang | |
| 2011/0155335 | A1* | 6/2011 | Jiang | D21C 3/022 162/55 |
| 2012/0067533 | A1* | 3/2012 | Kurosu | D21C 3/02 162/19 |

FOREIGN PATENT DOCUMENTS

| | | | | |
|---|---|---|---|---|
| JP | 2000336587 | | 12/2000 | |
| SE | WO 2011102760 | A1 * | 8/2011 | D21C 3/22 |
| WO | 9914423 | | 3/1999 | |
| WO | 03057979 | | 7/2003 | |

OTHER PUBLICATIONS

Grace editor, Pulp and Paper Manufacture: Alkaline Pulping, 1989, The Joint Textbook Committee of the Paper Industry, vol. 5 3rd edition, p. 98-105, 114-117, 216-219.

Teder, A., Redux Potential of Polysulfide Solutions and Carbohydrate Stabilizatin. THe Central Laboratory of the Swedish Cellulose INdustry (CCL), Stockholm, Sweden, Svensk Papperstidning drg. 71, Nr. 5, Mar. 15, 1968.

Jiang, Extended modified cooking of Southern pine with polysulfide; effects on pulp yield and physical properties, 1994, TAPPI Journal, vol. 77 No. 2.

Gullichsen editor, Chemical Pulping 6A, 1999, Fapet Oy, p. A119, A516.

* cited by examiner

KRAFT COOKING METHOD USING POLYSULFIDE COOKING LIQUOR

PRIOR APPLICATIONS

This is a continuation-in-part application of U.S. national phase application Ser. No. 14/241,141, filed 6 May 2014 that is based on and claims priority from International Application No. PCT/SE2011/051038, filed 30 Aug. 2011.

FIELD OF THE INVENTION

The present invention relates to a method for the preparation of kraft pulp with increased pulping yield from lignin-containing cellulosic material using polysulfide cooking liquor.

BACKGROUND AND SUMMARY OF THE INVENTION

In conventional kraft cooking implemented in the 1960-1970-ies in continuous digesters was the total charge of white liquor added to the top of the digester. It soon emerged that the high alkali concentrations established at high cooking temperatures were detrimental for pulp viscosity.

Cooking methods were therefore developed in order to reduce the detrimental high alkali peak concentrations at start of the cook, and thus were split charges of alkali during the cook implemented in cooking methods such as MCC, EMCC, ITC and Lo-Solids cooking.

Other cooking methods were implemented using black liquor impregnation ahead of cooking stages where residual alkali in the black liquor was used to neutralize the wood acidity and to impregnate the chips with sulfide. One such cooking method sold by Metso is Compact Cooking where black liquor with relatively high residual alkali level is withdrawn from earlier phases of the cook and charged to a preceding impregnation stage.

One aspect of alkali consumption during the cooking process, i.e. including impregnation, is that a large part of the alkali consumption is due to the initial neutralization of the wood acidity, and as much as 50-75% of the total alkali consumption is occurring during the neutralization process. Hence, a lot of alkali is needed to be charged to the initial neutralization. This establish a cumbersome problem as high alkali concentrations had been found to be detrimental for pulp viscosity when charged to top of digesters in conventional cooking. One solution to meet the high alkali consumption and necessity to reduce alkali concentration in top of digester was to charge large volumes of alkali treatment liquors, preferably black liquor having a residual alkali content, but having low alkali concentration, which resulted in presence of relatively large amount of total alkali per kg of wood material but still at low alkali concentration.

IN U.S. Pat. No. 7,270,725 (=EP1458927) Metso disclosed a pretreatment stage using polysulfide cooking liquor ahead of black liquor treatment. In this process was the polysulfide treatment liquor drained after the pretreatment stage and before starting the black liquor treatment. The polysulfide treatment stage was also preferably kept short with treatment time in the range 2-10 minutes.

In a recent granted U.S. Pat. No. 7,828,930, is shown an example of a kraft cooking process where 100% of the cooking liquor, in form of polysulfide liquor also named as orange liquor, is charged to top of digester and start of an impregnation stage. Here is also the temperature raised from 60° C. to 120° C. at start of the polysulfide treatment stage.

However, as shown in example 1 is a liquor to wood ratio of about 3.5 established in the top of the digester by adding a proper amount of water. This order of liquor/wood ratio is often perceived as a standard liquor/wood ratio in continuous cooking necessary for a steady process. According to this proposal is a part of the residual polysulfide treatment liquor at relative high alkali concentration withdrawn and replaced with cooking liquor at relative low alkali concentration at start of the cooking stage, and the withdrawn residual polysulfide treatment liquor is added at later stages of the cook.

There has thus been an ongoing development of cooking methods where both alkali concentrations at start of cook were reduced, and increased yield from the cooking process is sought for using among others addition of polysulfide cooking liquor that stabilize the carbohydrates.

The present invention is based upon the surprising finding that concentration of polysulfide should be kept high in a low temperature pretreatment stage at relatively long retention time before cooking, using liquor-to-wood ratios (L/W ratios) well below that were commonly used. The stabilization effect of carbohydrates, the major objective for polysulfide addition, has shown to be improved dramatically if using a liquor-to-wood ratio of about 2.9 instead of the conventional liquor to wood ratio of about 3.5, and all other conditions equal. This non-proportional effect of low liquor to wood ratio has not been disclosed or realized before despite the numerous proposals for improving cooking yield using polysulfide cooking liquor.

One object of the present invention is to provide an improved method for the preparation of kraft pulp with increased pulping yield from lignin-containing cellulosic material using polysulfide cooking liquor, wherein the lignin-containing cellulosic material is heated to a temperature in the range 50-100° C. followed by adding polysulfide cooking liquor to a first impregnation stage which in turn is followed by cooking stages resulting in a kraft pulp with a kappa number in the interval of 15 to 50, and more preferred in the interval of 17 to 40, and most preferred in the interval of 20 to 40. For some applications, for example when polysulfide cooking liquor is added to a first impregnation step, which is followed by a cooking stage and a refining step, to produce kraft liner, the kappa number can be higher, for example in the interval of 40 to 120, and more preferred in the interval of 70-110, and most preferred in the interval of 80 to 110. The impregnation stage of the improved method of the present invention is conducted at high alkali concentration, low temperature and high polysulfide concentration using polysulfide cooking liquor at a liquor-to-wood ratio in the range 2.0 to 3.2, and that the temperature is between 80-120° C. during a retention time resulting in a h-factor in the range 2-20 and preferably 2-10 of the impregnation stage. This low h-factor is indicative for that no cooking or delignification effect is obtained in the first impregnation stage, and hence is no reduction in pulp viscosity seen as could be the case if high alkali concentrations are at hand in cooking stages at higher temperatures.

According to one preferred embodiment of the method is the effective alkali concentration during the impregnation stage above 60 g/l when adding the polysulfide cooking liquor.

According to another preferred embodiment of the method is the polysulfide concentration during the impregnation stage above 3 g/l, or above 0.09 mol/l, when adding the polysulfide cooking liquor.

According to a further embodiment of the method is more than 90% of the total charge of cooking liquor needed for completion of the cooking stages to the intended kappa number below 40 charged to the first impregnation stage, and that at least 175 kg of alkali (EA as NaOH) per ton of chips is charged for softwood and at least 160 kg of alkali per ton of chips for hardwood.

According to yet another embodiment of the method is the alkali concentration reduced by at least 8 g/l by adding additional cooking liquids having less alkali concentration than the alkali concentration prevailing at end of the first impregnation stage when increasing the temperature to cooking temperature, said cooking liquids in at least part thereof include black liquor.

In a most preferred embodiment of the method is no black liquor added to the first impregnation stage.

When using the inventive method has also preferably the white liquor added to the first impregnation stage an alkali concentration above 100 g/l and a polysulfide concentration above 4 g/l.

The lignin-containing cellulosic materials to be used in the present process are suitably softwood, hardwood, or annual plants.

DETAILED DESCRIPTION OF THE INVENTION

Figure 1:
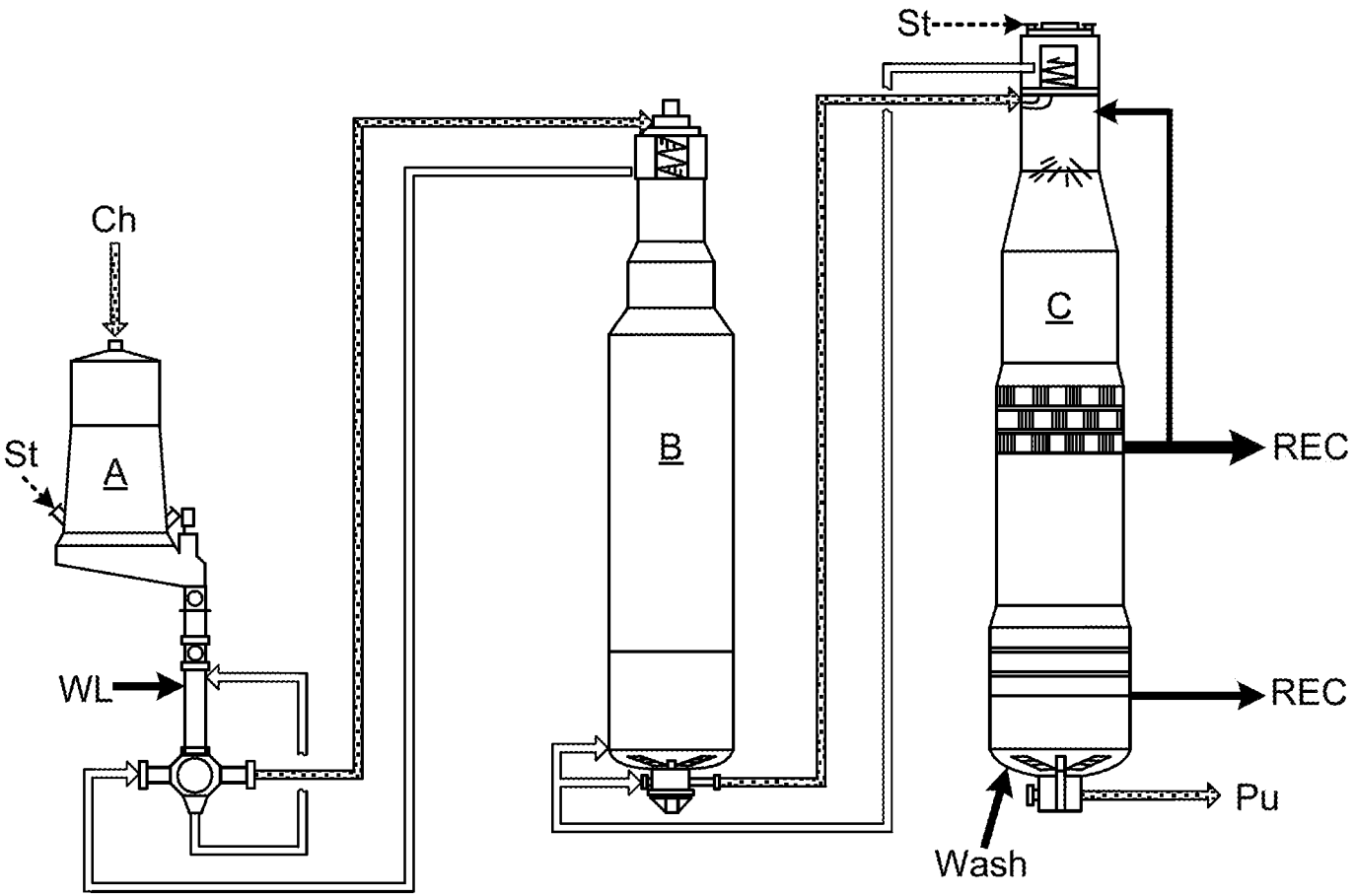
FIG. 1 is a schematic cooking system of the present invention capable of implementing the inventive method.

FIG. 1 shows a 2-vessel kraft cooking system, that has a first hydraulic impregnation vessel B and a second steam/liquid phase digester C, wherein the inventive method could be implemented. In this type of system the lignin containing cellulosic material Ch is first fed to a bin A wherein the cellulosic material is heated to a temperature in the range 50-100° C. by using addition of steam (St). The lignin containing cellulosic material could preferably be wood chips. From the lower part of the bin A are then the heated chips suspended in treatment liquor in a chute C located above the high pressure sluice feeder (SF). The treatment liquor here is preferably only polysulfide cooking liquor, WL, and preferably the entire charge of cooking liquor needed for the cooking process is charged here.

The chips suspended in the treatment liquor are fed to the sluice feeder and displaced liquid is fed out from the bottom outlet of the sluice feeder and returned to the chute in a low pressure circulation. The chips in the sluice feeder are pressurized by the return flow from the vessel B and fed out to the top separator TS in top of the vessel B.

Thus, the first impregnation stage is implemented in the vessel B and preferably only with the polysulfide cooking liquor and as small amount as possible of additional liquids such as wood moisture, steam condensates, and especially no black liquor nor additional water or filtrates. The resulting liquor-to-wood ratio established should be in the range 2.0 to 3.2 and the temperature should be in the range 80-120° C.

After the sufficient retention time in vessel B, which should have a retention time resulting in an H-factor in the range 2-20 of the impregnation stage, the impregnated chips are fed to the steam/liquid phase digester C together with the residual treatment liquor. Here is shown a conventional transfer system with dilution in bottom of the vessel B using withdrawn treatment liquor from the top separator TS in the top of vessel C. At this point, the chip suspension is heated to full cooking temperature, in the range 140-170° C. depending upon type of cellulosic material, and additional liquid is added in order to reduce the alkali concentration. This embodiment shows the addition of black liquor obtained from a screen section withdrawing black liquor and sending a part of this black liquor to recovery REC. Hence, no detrimental effects upon pulp viscosity would occur by this dilution with black liquor. In this embodiment is shown a digester C with 2 concurrent cooking zones, one cooking zone above the first screen section and a second cooking zone above the final screen section at the bottom of the digester. In a conventional manner, a final counter current wash zone is implemented at the bottom of the digester by addition of wash water/Wash. The final pulp with a kappa number, preferably, below 40 is fed out from the bottom in flow Pu. As indicated above, the present invention is not limited to kappa numbers below 40 and that kappa numbers above 40 up to about 110 and even 120 may be used followed by refining.

Figure 2:
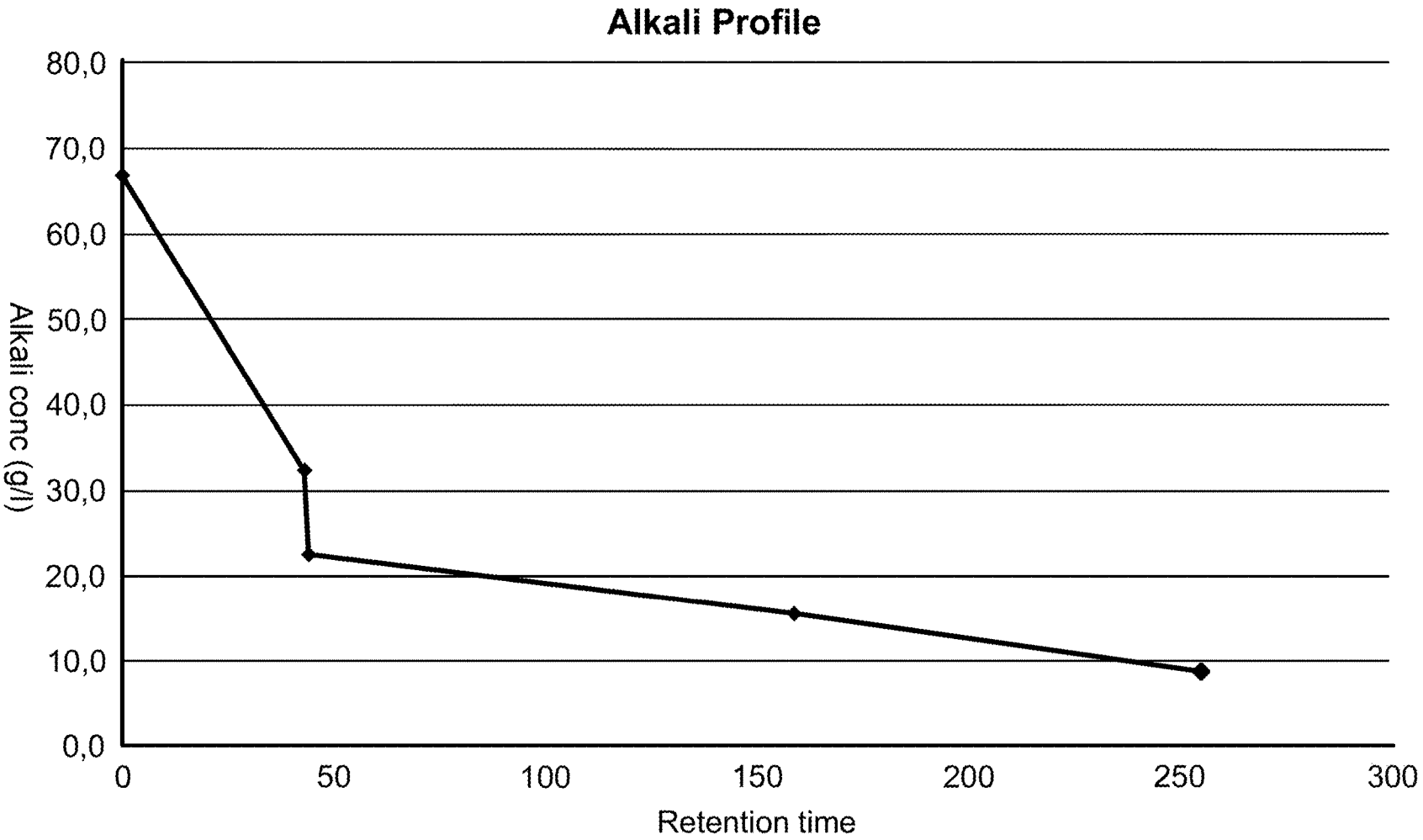
FIG. 2 demonstrates an example of the alkali profile established with the inventive method of the present invention.

FIG. 2 discloses the alkali concentration profile that could be established in a system like that disclosed in FIG. 1, with alkali consumption of about 110 kg/BDT in the impregnation vessel, 45 kg/BDT in the first cooking zone in vessel C and 15 kg/BDT in last cooking zone in vessel C. At the top of the first impregnation vessel B an alkali concentration of about 67 g/l is established and this alkali level drops down to about 32 g/l at the bottom of vessel B, where a dilution is made by return flows added to bottom. Combined with the dilution with black liquor in top of digester vessel C, the cooking at the top of the digester starts at an alkali concentration of about 22 g/l. Due to the dilution to a liquor-to-wood ratio of about 6.5 is however a sufficient total amount of alkali present. During the cook, the alkali concentration drops evenly, first to a level of about 16 g/l at first withdrawal screen, and finally down to about 8 g/l in the final withdrawal screen. It is to be noted that a part of the withdrawn black liquor at a concentration of about 16 g/l is recirculated back to the top of vessel C. With this alkali profile an improved usage of the polysulfide is obtained as it is used in the first impregnation stage at high alkali concentration, low temperature and high polysulfide concentration.

Figure 3:
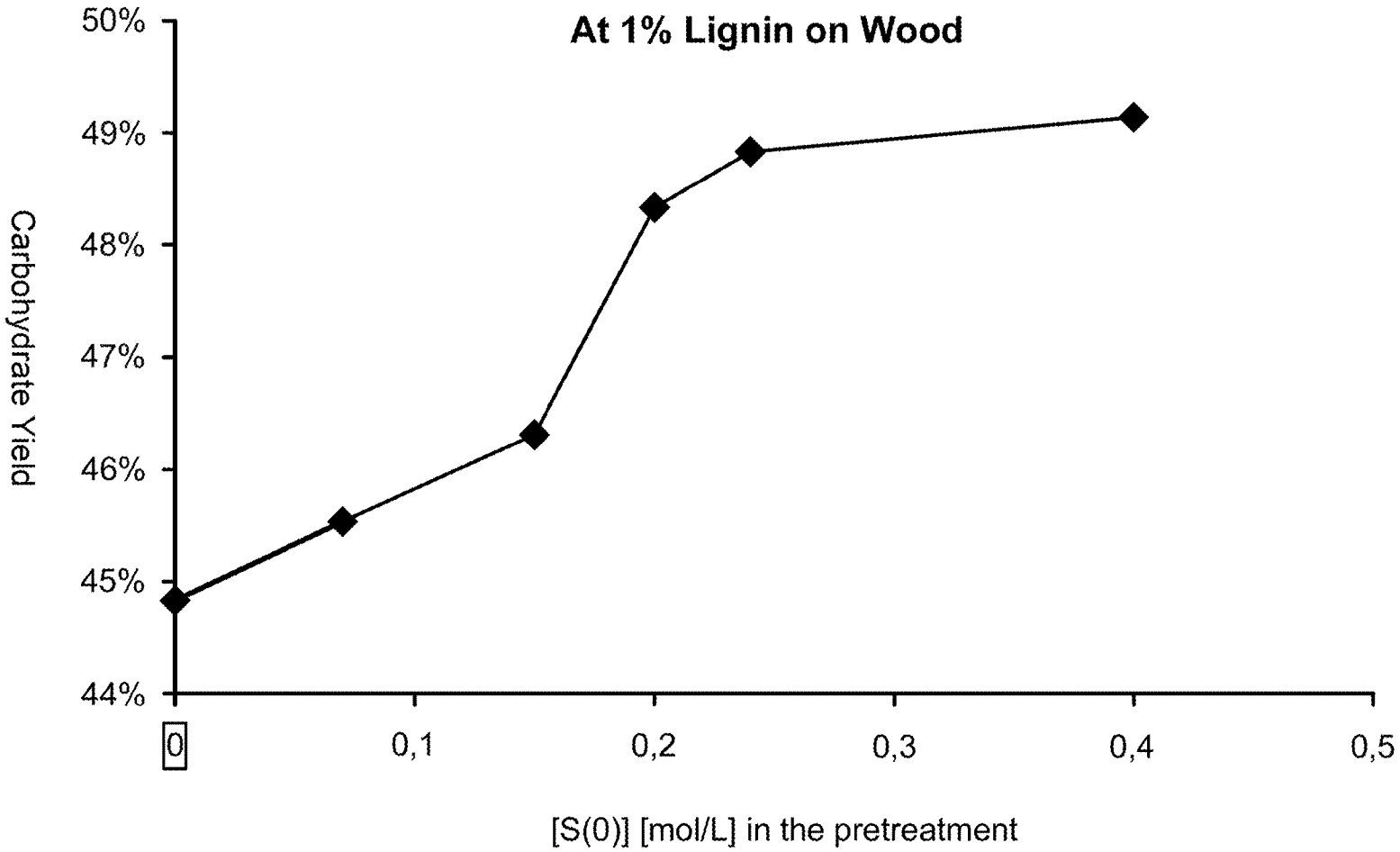
FIG. 3 shows the dramatic impact on increased yield when increasing the polysulfide concentration above 0.15 mol/l.

FIG. 3 discloses the improved carbohydrate yield as a function of the polysulfide concentration, when about 1% lignin is still present in the pulp. The dramatic increase in yield is here shown when increasing the polysulfide concentration above 0.15 mol/l. There is basically a linearly increasing yield when the concentration increases between 0 to 0.15 mol/l. In this initial range the yield is increased from about 45% up to about 46.2%. However, when the concentration reaches 0.2 mol/l the yield is increased to about 48.3%.

EXAMPLES

A series of tests has been made simulating a system as that shown in FIG. 1 using white liquor that has an alkali concentration of about 117 g/l and a polysulfide concentration of about 6 g/l. The charges of flows to the first impregnation stage are in tests #1-7 using part flows a-e. This results in a liquor-to-wood ratio shown in row L/W. The respective concentrations established are shown in rows f to j.

$S_nS^{2-}$ Despite the presence of a number of different polysulfide ions, each polysulfide ion can be considered to consist of one atom "sulfide sulfur", i.e. sulfur in the formal oxidation state S(−II), and n atoms of polysulfide "excess sulfur", i.e. sulfur in the formal oxidation state S(0).

$$[S-II)]=[HS—]+\Sigma[S_nS^{2-}]$$

$$[S(0)]=\Sigma n[S_nS^{2-}]$$

Finally, the Xs factor has been calculated using the formula:

$$Xs=[S(0)]/[S(-II)]$$

and the carbohydrate stabilization has been calculated using the formula*:

$$\text{Log } [S(0)]+1.7 \log [OH—]-1.6 \log(1/Xs-¼)$$

(*see Teder, A. (1965):Svensk Papperstidn. 68:23, 825)

recovery line REC of digester C and conveyed in conduit 204 to the heater 202, so that the incoming hot black liquor can exchange heat with the incoming white liquor to heat the white liquor to a temperature of 100-140° C. The cooled black liquor is then conveyed or re-circulated in conduit 205 from heater 202 to recovery line REC. As indicated in the table, condensate, such as in the form of steam (ST), may also be used to provide heat to the chips, flowing in chip bin A, to a temperature of about 100° C. and the chips are then further heated by the heated cooking liquor that has been heated in heater 202. It is also possible to use a system that does not preheat the chips with steam. By heating up the WL (containing polysulfide) the steam demand, and hence the condensate amount, to reach a certain temperature is reduced. This has a positive impact on both heat economy and the reduction of L/W ratio required. The specific steam consumption could be reduced by up to 50 kg/BDT and the L/W ratio could be reduced by up to 0.05 $m^3$/BDT.

Figure 4:
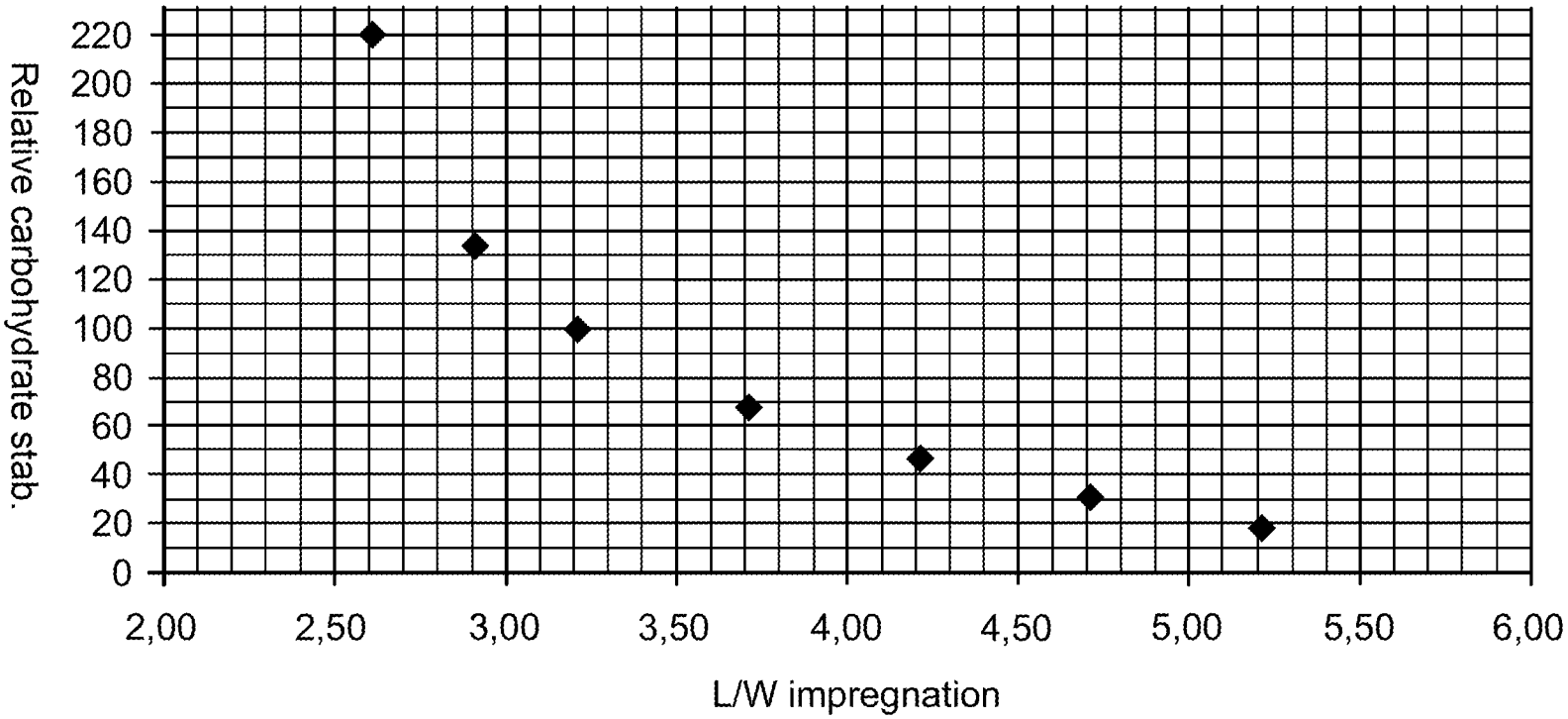
FIG. 4 shows the relative stabilization of carbohydrates as a function of liquid to wood ratio during the impregnation stage.

It was surprising and unexpected to realize that the advantages of the improved carbonization stabilization, best shown in FIG. 4 and in the table above, greatly outweigh the costs associated with the required modifications of the processing and extra equipment needed to accomplish this.

| | #1 | #2 | #3 | #4 | #5 | #6 | #7 |
|---|---|---|---|---|---|---|---|
| a WL ($m^3$/BDT) | 1.79 | 1.79 | 1.79 | 1.79 | 1.79 | 1.79 | 1.79 |
| b Moisture ($m^3$/BDT) | 0.82 | 0.82 | 0.82 | 0.82 | 0.82 | 0.82 | 0.82 |
| c Condensate ($m^3$/BDT) | 0 | 0.3 | 0.3 | 0.3 | 0.3 | 0.3 | 0.3 |
| d BL to feed ($m^3$/BDT) | 0.0 | 0.0 | 0.0 | 0.5 | 1.0 | 1.5 | 2.0 |
| e Knots to feed ($m^3$/BDT) | 0 | 0 | 0.3 | 0.3 | 0.3 | 0.3 | 0.3 |
| L/W | 2.61 | 2.91 | 3.21 | 3.71 | 4.21 | 4.71 | 5.21 |
| f NaOH (g/1) | 80.4 | 72.1 | 65.9 | 59.2 | 54.1 | 50.0 | 46.8 |
| g OH (mol/l) | 2.0 | 1.8 | 1.6 | 1.5 | 1.4 | 1.3 | 1.2 |
| h PS (g/l) | 4.12 | 3.70 | 3.35 | 2.90 | 2.56 | 2.28 | 2.07 |
| i PS (mo/l) | 0.13 | 0.12 | 0.10 | 0.09 | 0.08 | 0.07 | 0.06 |
| j HS (mo/l) | 0.07 | 0.08 | 0.10 | 0.11 | 0.12 | 0.13 | 0.14 |
| Xs | 1.81 | 1.37 | 1.1 | 0.83 | 0.67 | 0.56 | 0.48 |
| Carbohydrate stab (test #3 is reference) | 220 | 134 | 100 | 68 | 47 | 31 | 19 |

In the tests 3-7, a flow of knots to feed of 0.3 $m^3$/BDT was used, as presented in the table above. However, the present invention is also applicable for other flow rates, and the flow of knots to feed can be in the interval of 0.05 to 0.6 $m^3$/BDT, and more preferably in the interval of 0.20 to 0.5 $m^3$/BDT, and most preferred in the interval of 0.25 to 0.35 $m^3$/BDT.

FIG. 4 discloses the relative carbohydrate stabilization from the above examples as a function of liquor-to-wood ratio during impregnation. Test #3 is used as the reference, i.e. 100%. The relative carbohydrate stabilization is roughly increasing linearly when decreasing the liquor-to-wood ratio during impregnation from 5.2 down to 3.7. However, a dramatic improvement is obtained when the liquor-to-wood ratio is reduced to and further below 3.2. While the relative carbohydrate stabilization increases from about 19 to about 68 in the liquor-to-wood ratio from 5.2 down to 3.7, it is increased to an astonishing 100 and further to about 134 and up to 220 at liquor-to-wood ratios of 3.2, 2.9 and 2.6, respectively.

Figure 5:
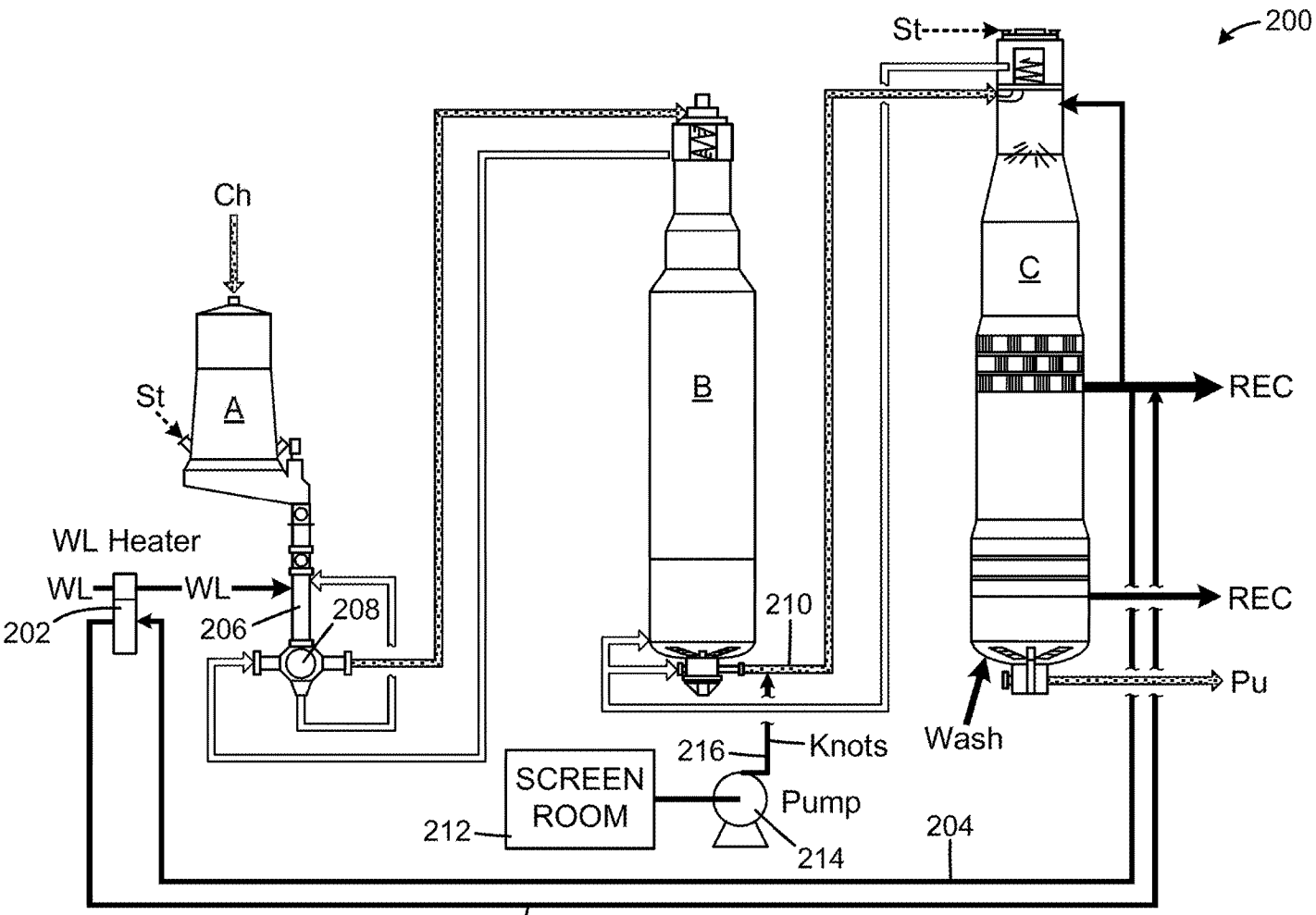
FIG. 5 is a schematic view of the cooking system of the present invention showing the extra heating system and input of knots.

FIG. 5 is a schematic view of the continuous cooking system 200 of the present invention that is substantially similar to the system shown in FIG. 1, but includes an additional heating system and input for knots. The cooking system 200 has a heater 202, such as a heat exchanger, for heating the incoming white liquor WL (preferably polysulphide). Hot black liquor is preferably withdrawn from a It was discovered that the concentration of polysulfide should be high and the L/W ratio should be low. In conventional sulphate cooking, there is little or no reason to use high concentrations because it is generally desirable to have a levelled out alkali-profile in sulphate cooking. In general, one reason for the positive effects of using a lower L/W ratio is that a lower L/W ratio, in practice, results in less dilution of both [OH-] and [S(0)] (and hence an increase in the Xs factor), and if these are not diluted as much it has a positive impact on the carbohydrate stabilization. L/W ratios below 3.5 in the impregnation have not been used before in connection with PS cooking because the full benefits were not realized and there were also technical obstacles that had to be overcome to make it work properly. For example, it is necessary to determine where to recirculate the knots (L/W of 0.3 $m^3$/BDT in the table above) and how to heat up the chips to the impregnation temperature without adding too much direct steam (L/W of 0.3 $m^3$/BDT as condensate in the table above) and preferably without the addition or recirculation of hot black liquor to the impregnation stage (which is industry practice for heat recovery). According to the principles of the present invention, it is thus desirable to use a low L/W ratio (below 3.5) in the impregnation but a high L/W ratio in the cooking stages.

There are many drawbacks of using L/W ratios in the impregnation stage that are lower than 3.5, which are why it has become conventional practice in the pulping industry to use L/W ratios of at least 3.5 in the impregnation in connection with PS cooking as well as in conventional kraft cooking and especially in enhanced kraft cooking processes. For example, when using L/W ratios below 3.5, additional equipment is needed to heat up the chips by means of indirect heat such as by using heat exchangers and additional circulations. It is preferable to increase the temperature of the white/orange liquor WL in engagement with the heat exchanger, such as heater 202, prior to the liquor WL entering the chip chute 206.

It is also necessary to recirculate the knots to another position than the chip-chute 206 in order to lower the L/W ratio. It is important to realize that in most, if not all, pulping processes (such as in conventional sulphate cooking) it is common to recirculate the knots so as to improve the production efficiency and make sure the raw material is fully utilized. For example, the knots are normally added to the chip chute 206 associated with the low-pressure side of the sluice feeder 208 (such as to the low-pressure recirculation line that extends from the sluice feeder 208 to chip chute 206. The pressure where the knots are normally added to the chip chute 206 is usually 1-1.5 bar (g). Another reason for adding the knots to the chip chute 206 in conventional sulphate cooking is that it is advantageous in sulphate cooking to cook the knots again and to re-impregnate, i.e. impregnate the knots again before they enter into the digester C. If, instead, the knots are added after the impregnation vessel B (as is preferably done in the present invention) but before the digester C, the pressure is at least 3-4 bar (g) and in most cases as high as 11-13 bar (g). There are thus several drawbacks of adding the knots after the impregnation vessel B, as is done in the present invention. By adding the knots after the impregnation vessel B, the pressure is much higher that requires a larger pump and it is not possible to re-impregnate the knots before they enter the digester C. FIG. 5 shows the knots being added to conduit 210 that extends between the bottom of impregnation vessel B to the top of the digester C. The knots are preferably conveyed from a screen room 212 and pumped by a high-pressure pump 214 into conduit 210 via conduit 216. The table above has a "knots to feed" category (see line (e)). This relates to adding knots to the low-pressure chip chute 206 prior to the sluice feeder 208. When knots are added to the chip chute 206, the L/W ratio in the example of the current application increases from 2.91 to 3.21 (when the other parameters on lines (a)-(d) are not changed). An important feature of the present invention is thus to add the knots via conduit 216 into conduit 210 instead despite the higher pressure in order to keep the L/W ratio as low as possible in the impregnation vessel B. The higher counter-pressure for the knot-return in conduit 210 results in higher energy consumption and the need for the relative powerful knot pump 214 compared to when the knots are added to the low-pressure part of the chip chute 206. The use of L/W ratios lower than the conventional 3.5 also results in tougher working conditions for the chip feed going into the impregnation vessel (top separator).

As indicated above, an L/W ratio of 3.5 is conventionally used (prior to the development of the present invention) in impregnation in connection with PS cooking because direct steam ST and the knots are traditionally added to the chip chute 206 going into the sluice feeder 208. As indicated above, this results in an increased L/W ratio during impregnation. Additionally, black liquor recirculation for L/W control purposes is traditionally used, which also increases the L/W ratio. In other words, conventional systems are designed to add the knots to the chip chute 206 and black liquor is often recirculated which further increases the L/W ratio in the impregnation stage. Another reason why L/W ratios lower than 3.5 have not conventionally been used is that the mechanical limitations of the top separators require a higher liquid flow so that it is necessary to increase the revolutions-per-minute (rpm) of the top separator that, in turn, increases the power consumption and wear of the top separator. Also, for conventional kraft-pulp production, the use of a higher L/W ratio, i.e. L/W ratio above 3.5, is desirable because it results in more leveled-out alkali profiles that optimizes the exchange of xylan. In contrast, in PS cooking it is desirable to have a rapidly declining alkali-concentration, as shown in FIG. 2. The decline is rapid in the impregnation (see the first 50 minutes of the retention time) and the decline is slower after 50 minutes retention time i.e. in the digester and the L/W ratio is much higher in the digester. The rapid decline of the alkali-profile is a consequence of the lower L/W ratio in the impregnation stage. Below is an example to illustrate this consequence.

Assuming there is an alkali consumption of 110 kg/BDT in the impregnation vessel. At a L/W ratio of 2.9 the delta alkali would be 110/2.9=38 g/l, at a charge of 19.5% EA, the initial alkali concentration would be (195/2.9) 67 g/l and the end alkali concentration would be 67-38=29 g/l. If, on the other hand, the L/W ratio is 5 during impregnation the delta alkali would be 110/5=22 g/l at the same charge, the initial alkali concentration would be 195/5=39 g/l and the end alkali concentration would be 39−22=17 g/l). It can be seen that the slope in the figure of the alkali consumption becomes less steep the higher L/W ratio is used. The main reason for this is that the starting point is diluted (67 vs 39 g/l) at the same charge and that the alkali reduction becomes less expressed as concentration when the UW ratio is higher (38 vs 22 g/l in delta alkali at constant consumption.

It was contrary to conventional thinking to start using a ratio lower than 3.5 because when converting to PS cooking no attention to the unique design requirements of PS cooking have been considered in the past because the potential advantages of changing the system design were not realized. PS cooking at L/W ratios below 3.5 (such as below 3.2) requires more equipment and a higher steam consumption (as indirect steam) since no hot black liquor would be recirculated to avoid any unnecessary L/W ratio increase. Through extensive experimentation and testing, it was realized that PS cooking at an L/W ratio of 2-3.2 in impregnation is advantageous although it requires the installation of additional heat exchangers, pumps, circulations and new addition points for the knots. After substantial experimentation, the surprising and unexpected conclusion was reached that the advantages of the improved relative carbonization stabilization by using lower L/W ratios (in the range 2-3.2) greatly outweighed the drawbacks of needing the additional equipment listed above such as the more powerful pump 214 to add knots into the high-pressure conduit 210, additional heat exchanger 202 and the higher indirect steam consumption.

Figure 6:
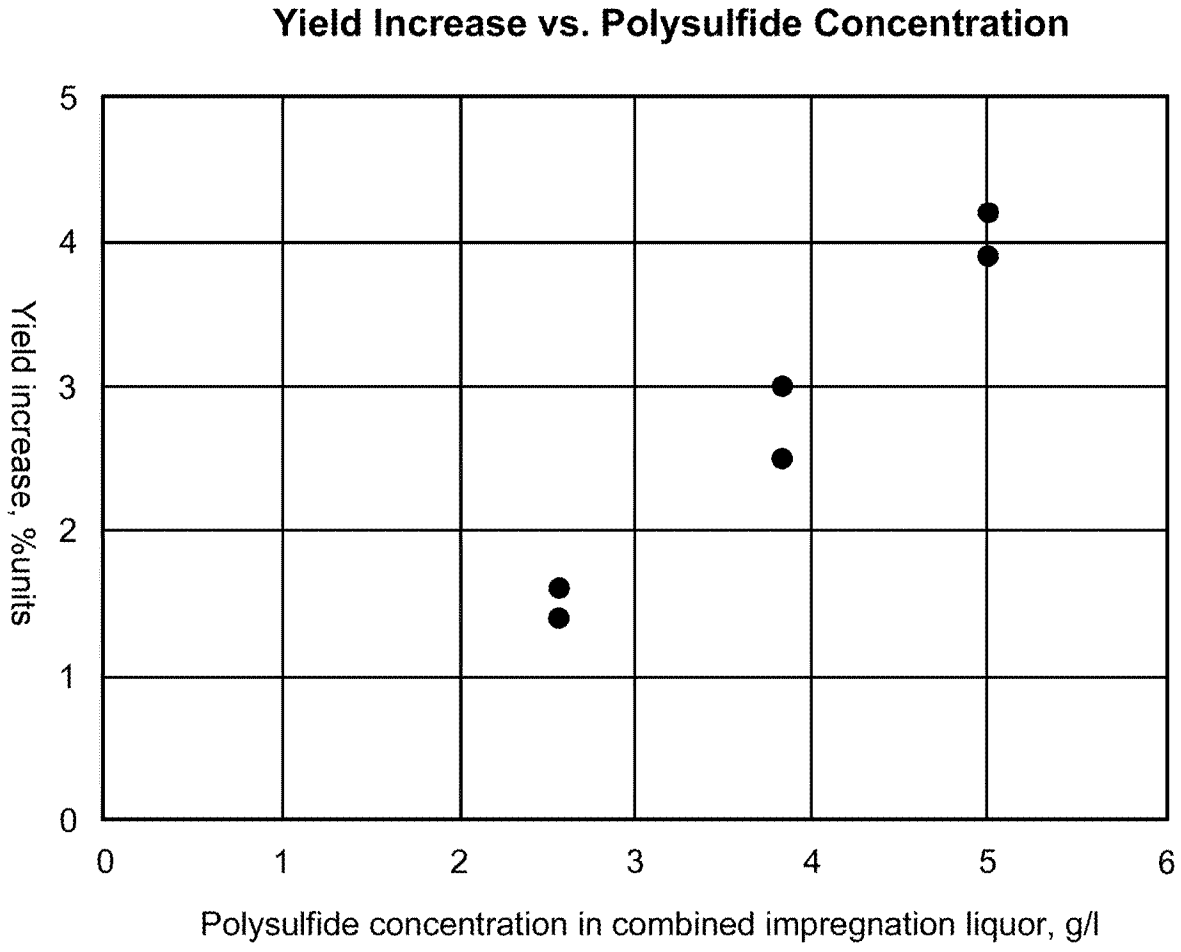
FIG. 6 is a graph showing a correlation between yield increase and polysulfide concentration.

FIG. 6 is a graph showing the improved yield versus polysulfide concentration that is the result of laboratory tests. The graph shows that the yield increases from about 1.5% at a PS concentration of about 2.5 g/l to about 4% at a PS concentration of about 5 g/l. It is thus advantageous to use a higher concentration of PS in order to improve the yield.

While the present invention has been described in accordance with preferred compositions and embodiments, it is to be understood that certain substitutions and alterations may be made thereto without departing from the spirit and scope of the following claims.

We claim:

1. A method for the preparation of kraft pulp with increased pulping yield from lignin-containing cellulosic material using polysulfide cooking liquor in a continuous cooking system, comprising:

providing an impregnation vessel in operative engagement with a digester via a high-pressure conduit, the impregnation vessel having a first impregnation stage;

heating a lignin-containing cellulosic material to a temperature in a range of 50-100° C. followed by adding polysulfide cooking liquor to the first impregnation stage which in turn is followed by cooking stages in the digester;

adding knots to the high-pressure conduit extending between the impregnation vessel and the digester; and conducting the first impregnation stage at high alkali concentration above 60 g/l (effective alkali (EA) as NaOH basis) when adding the polysulfide cooking liquor, wherein the polysulfide concentration is above 3 g/l, or above 0.09 mol/l, when adding the polysulfide cooking liquor, wherein the first impregnation stage has a liquor-to-wood ratio in a range of 2.0 to 3.2 in order to increase a relative carbohydrate stability, the liquor-to-wood ratio calculated as containing polysulfide cooking liquor and wood moisture, and that the temperature is between 80-120° C. during a retention time resulting in a H-factor in a range of 2-20 of the first impregnation stage.

2. The method according to claim 1 wherein the method further comprises providing a heater, the heater heating polysulfide cooking liquor prior to the polysulfide cooking liquor entering the impregnation vessel.

3. The method according to claim 2 wherein the method further comprises using a heat exchanger and exchanging heat between black liquor withdrawn from the digester with the polysulfide cooking liquor to heat the polysulfide cooking liquor.

4. The method according to claim 1 wherein more than 90% of the total charge of cooking liquor needed for completion of the cooking stages to the intended kappa number below 40 is charged to the first impregnation stage, and that at least 175 kg of effective alkali (EA as NaOH) for softwood and 160 kg of effective alkali for hardwood per ton of chips is charged.

5. The method according to claim 4 wherein the alkali concentration is reduced by at least 8 g/l (EA as NaOH basis) by adding additional cooking liquids having lower alkali concentration than the alkali concentration prevailing at end of the first impregnation stage when increasing the temperature to cooking temperature, said cooking liquids in at least part thereof includes black liquor.

6. The method according to claim 5 wherein no black liquor is added to the first impregnation stage.

7. The method according to claim 6 wherein the white liquor added to the first impregnation stage has an alkali concentration above 100 g/l (EA as NaOH basis) and a polysulfide concentration above 4 g/l.

8. The method according to claim 1 wherein the cooking stages in the digester results in a kraft pulp with a kappa number below 40.

* * * * *